US006829792B2

(12) United States Patent
Braly

(10) Patent No.: US 6,829,792 B2
(45) Date of Patent: Dec. 14, 2004

(54) SUN VISOR FOR HAMMOCKS

(75) Inventor: Clifford B. Braly, Arapahoe, NC (US)

(73) Assignee: Hatteras Hammocks, Inc., Greenville, NC (US)

( * ) Notice: Subject to any disclaimer, the term of this patent is extended or adjusted under 35 U.S.C. 154(b) by 2 days.

(21) Appl. No.: 10/619,120

(22) Filed: Jul. 15, 2003

(65) Prior Publication Data

US 2004/0177442 A1 Sep. 16, 2004

Related U.S. Application Data

(60) Provisional application No. 60/454,928, filed on Mar. 14, 2003.

(51) Int. Cl.[7] ..... A45F 3/22
(52) U.S. Cl. ..... 5/121; 5/120; 5/128; 135/117
(58) Field of Search ..... 135/117, 88.02, 135/88.03; 5/120, 121, 128

(56) References Cited

U.S. PATENT DOCUMENTS

| | | | | | |
|---|---|---|---|---|---|
| 445,049 | A | * | 1/1891 | Dicks | 5/123 |
| 940,939 | A | * | 11/1909 | Patterson | 5/129 |
| 1,053,337 | A | * | 2/1913 | Williams | 248/514 |
| 4,506,689 | A | * | 3/1985 | Fiddler | 135/133 |
| 4,739,784 | A | * | 4/1988 | Fast | 135/117 |
| 5,921,258 | A | * | 7/1999 | Francois | 135/88.03 |
| 2003/0056817 | A1 | * | 3/2003 | Miller et al. | 135/117 |

* cited by examiner

*Primary Examiner*—Teri Pham Luu

(57) ABSTRACT

A sun visor is described for mounting on the front spreader bar of a hammock, so that it extends up from and over the front spreader bar. It includes a stabilizer spar operatively connected to the front spreader bar and extending outward therefrom through and under the ropes of the hammock's clew.

5 Claims, 3 Drawing Sheets

SUN VISOR FOR HAMMOCKS

This application claims benefit of provisional application No. 60/454,928 filed Mar. 14, 2003.

FIELD OF THE INVENTION

The present invention relates to hammocks and, in particular, to a sun visor accessory for shielding the face of a user.

BACKGROUND OF THE INVENTION

Various approaches have been taken for providing sun visors and screens on hammocks to shield the face of a user from direct sunlight and glare conditions. One of the major difficulties is providing a stable orientation of the visor under varying and constantly shifting loads. This is particularly true when the visor is mounted on the upper spreader bar. The spreader bar tends to rotate in accommodating the changing relative inclination between the clew and the hammock bed and consequently shifts the orientation of the visor. Auxiliary struts and tie lines have been employed to minimize the effect, adding to the cost and complexity of the hammock and providing only marginal results.

It is, accordingly, an object of the present invention to provide a visor that can be directly incorporated into existing hammock designs, either as original equipment or as an accessory, and remain stable in positioning for widely varying users and conditions.

DISCLOSURE OF THE PRIOR ART

Applicant is aware of no prior art that directly relates to or anticipates this invention.

PRIOR PROVISIONAL PATENT APPLICATION

This application is based on the prior Provisional Patent Application Ser. No. 60/454,928, filed Mar. 14, 2003. Applicant claims that priority and all other benefits derived from the prior Provisional Patent Application.

SUMMARY OF THE INVENTION

DETAILED DESCRIPTION OF THE INVENTION

Figure 1:
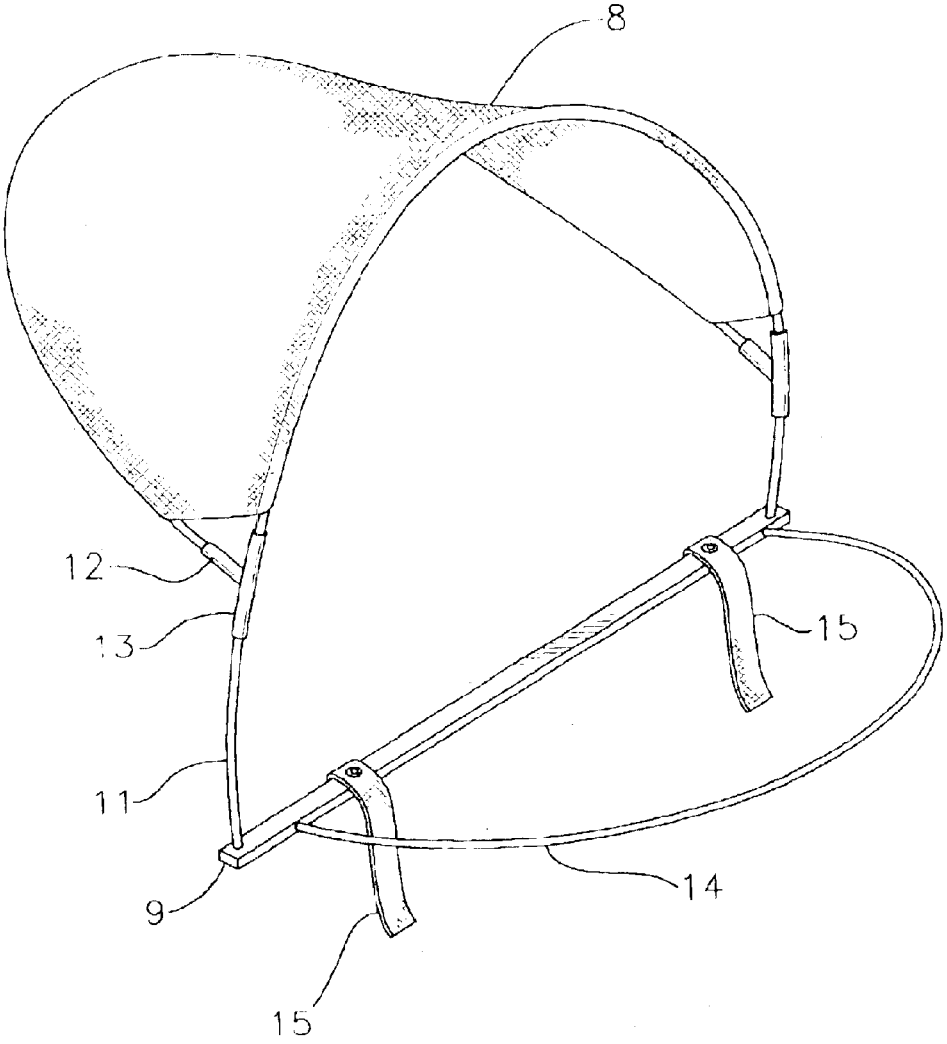
FIG. 1 is a side perspective view of the sun visor.
Figure 2:
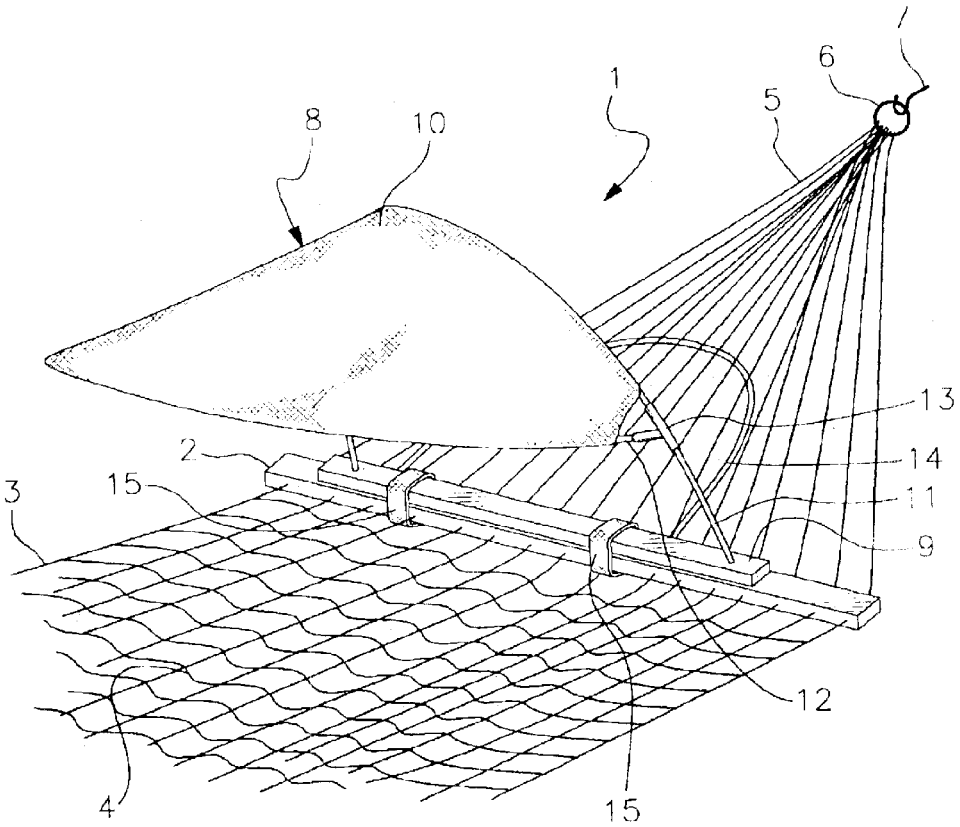
FIG. 2 is a side perspective view of the sun visor as attached to a hammock.
Figure 3:
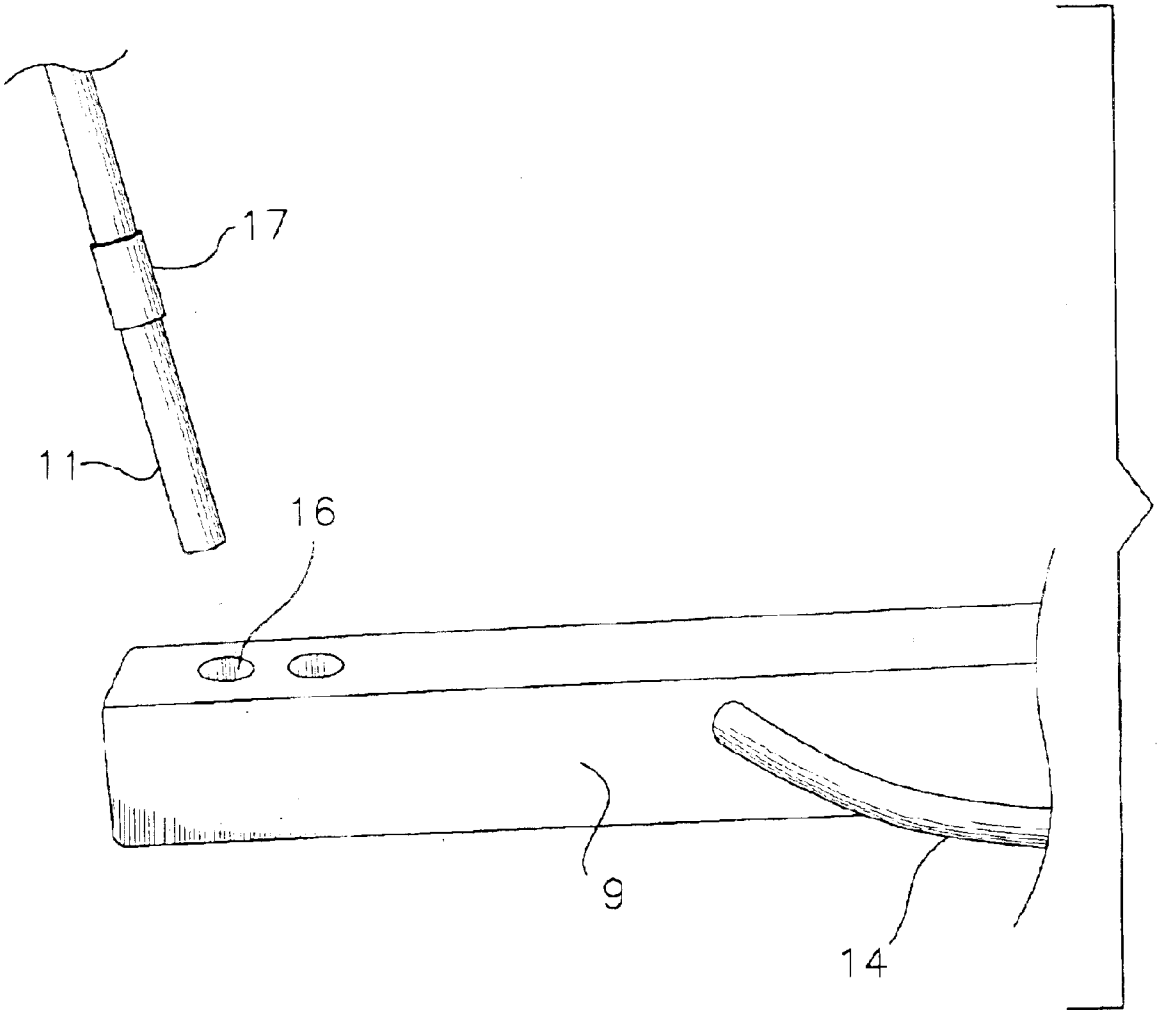
FIG. 3 is a detailed perspective view of the main spar and stabilizing spar, as connected to the supplemental spreader bar.

In accordance with the present invention, a sun visor is provided that can be incorporated into existing hammocks and which functions to shade the user's face from direct sunlight or glare. The sun visor comprises a fabric visor panel, which is supported by a secondary spar extending out from a main spar which is attached to a forms a vertical arch over a supplemental spreader bar. The supplemental spreader bar has straps by which it can be attached to the standard spreader bar of a hammock. It also has a stabilizing spar which is attached to and forms a horizontal arch out from the supplemental spreader bar. The stabilizing spar extends through and under the ropes of the hammock's clew.

Referring to the drawings, a sun visor 1 according to an embodiment of the invention is mounted at the front spreader bar 2 of a hammock 3. The spreader bar 2 is conveniently located between the hammock bed 4 and the rope clew 5 connected to terminal support 6 that is releasably connected to external support hook 7 attached to a stable vertical support such as a tree, or to a free standing support stand.

The visor 1 comprises a fabric canopy assembly 8 mounted on a supplemental spreader bar 9. Alternatively, as will become apparent, the canopy assembly 8 includes a fabric visor panel 10 carried at outer margins by a main spar 11 and a secondary spar 12 slidably supported on the main spar 11 at coupling 13, and a stabilizing spar 14. The spars 11, 12 and 14 are thin elongated members formed of relatively stiff but flexible material such as fiberglass.

The supplemental spreader bar 9 is formed of a material compatible with the spreader bar 2, preferably a wood material covered with an exterior grade finish. The supplemental bar 9 is releasably attached to the spreader bar 2 by loop straps 15.

The main spar 11 has ends fixedly retained in inclined holes 16 formed at the lateral ends of the supplemental spreader bar 9. Cylindrical stop collars 17 are provided adjacent the ends of the main spar 11 to retain the couplings 13 thereon. The axes of the holes 16 in the spreader bar are inclined slightly inwardly at a shallow angle if between about 5° to 10°. In assembly with the ends secured in the holes in the main spar 11 elastically flexes into a curvilinear domed shaped having an arcuate top and downwardly and outwardly slanting lower legs.

The coupling 13 comprises an apertured cylindrical body slidably supported on the main spar 11 and having a transverse hole. The coupling is formed of a suitable compatible material, such as molded plastic. The secondary spar 12 has ends received in the transverse holes of the coupling 13 thereby flexibly assuming a curvilinear shape extending horizontally rearwardly of the main spar 11.

The visor panel 10 is formed of a woven material such as nylon. The panel 10 has a hemmed sleeve for receiving the secondary spar 12 and a stitched base sleeve for receiving the main spar 11. In assembly, the panel is configured to provide longitudinal tensioning by slightly upwardly flexing the secondary spar 12 at the couplings 13. The couplings 13 are downwardly shifted on the main spar 111 to provide material and downward tensioning of the panel 10. The tensioning of the secondary spar 12 flexes the coupling 13 into a locked frictional engagement with the main spar 11.

The stabilizing spar 14 has ends retained in inclined holes formed in the front vertical face of the supplemental spreader bar 9 laterally inwardly of the holes for the main spar 11. In assembly, the stabilizing bar 14 assumes a curvilinear flexed configuration.

The visor may be readily mounted on a hammock by securing the supplemental spreader bar 9 to the top of the spreader bar 2 using the fastener loop straps 15. Thereafter or previously, the main spar is assembled, the secondary spar attached at the couplings, and the panel 10 adjusted thereabout. Then, the stabilizing spar 14 is positioned through and beneath the clew ropes 5, flexed and the ends inserted upwardly between the clew ropes 5 into the front mounting holes on the supplemental spreader bar 9.

During occupancy of the hammock, there is a tendency for the hammock bed 4 to sag with a consequent rocking of the front spreader bar 2. This tendency is counteracted by the torsional resistance provided by the stabilizing spar 14 to maintain the angularity between the clew ropes and spreader bars 2 and 9, thus providing a stable orientation for the visor 1.

Having thus described a presently preferred embodiment of the present invention, it will now be appreciated that the objects of the invention have been fully achieved, and it will be understood by those skilled in the art that many changes in construction and widely differing embodiments and application of the invention will suggest themselves without departing from the spirit and scope of the present invention. The disclosures and description herein after intended to be illustrative and are not in any sense limiting of the invention, which is defined solely in accordance with the following claims.

What is claimed is:

1. A sun visor for mounting on a hammock having a hammock bed surface extended between front and rear spreader bars and a rope clew extended from said front spreader bar to a terminal support means, said sun visor comprising:

a sun visor assembly supported from and extending up from and over said front spreader bar;

an elongated flexible stabilizing spar having its opposite ends operatively connected to the said front spreader bar and assuming a curvilinear configuration frontwardly thereof, some portion of said curvilinear configuration extending below the said rope clew.

2. The sun visor of claim 1, in which the sun visor assembly comprises:

an elongated flexible main spar operatively connected to the front spreader bar at opposite ends thereof and assuming a curvilinear configuration thereon defined by an arcuate upper section and downwardly extended legs;

an elongated flexible secondary spar having its opposite ends attached to the legs of the main spar and assuming a curvilinear configuration rearwardly thereof; and a flexible panel connected to and extending between said main spar and said secondary spar.

3. The sun visor of claim 2, in which the said sun visor assembly is operatively connected to said front spreader bar by means of supplemental spreader bar which is removably attached to said front spreader bar, and to which the main spar, secondary spar and stabilizing spar are attached.

4. The sun visor of claim 3, in which the supplemental spreader bar is removably attached to said front spreader bar by means of loop straps which extend from the supplemental spreader bar and wrap around said front spreader bar.

5. The sun visor of claim 2, in which the said flexible panel is fabric.

* * * * *